United States Patent [19]

de Vries et al.

[11] 4,343,086

[45] Aug. 10, 1982

[54] SHAVING APPARATUS

[75] Inventors: Jochem J. de Vries; Ferdinand M. Trees, both of Drachten, Netherlands

[73] Assignee: U.S. Philips Corporation, New York, N.Y.

[21] Appl. No.: 146,553

[22] Filed: May 5, 1980

[30] Foreign Application Priority Data

May 23, 1979 [NL] Netherlands ..... 7904042

[51] Int. Cl.[3] ..... B26B 19/14

[52] U.S. Cl. ..... 30/43.6

[58] Field of Search ..... 30/43.5, 43.6, 41.5, 30/41.6

[56] References Cited

U.S. PATENT DOCUMENTS 3,890,709 6/1975 Tietjens ..... 30/43.6

4,240,199 12/1980 Boiten ..... 30/43.6

FOREIGN PATENT DOCUMENTS 2030911 4/1980 United Kingdom ..... 30/43.6

*Primary Examiner*—Nicholas P. Godici

*Attorney, Agent, or Firm*—Thomas A. Briody; William J. Streeter; Rolf E. Schneider

[57] ABSTRACT

There is provided a shaving apparatus having a shear plate formed with hair entry apertures and a cutting unit rotatable relative to the shear plate. The cutting unit comprises a cutting member having a central body provided with cutters, a hair-pulling member having a central portion, hair-pulling elements respectively associated with and movable relative to the cutters, respective connecting arms extending from the hair-pulling elements to the central portion of the hair-pulling member, and an annular cover plate positioned over the inner ends of the connecting arms and engaging the central portion. The central body and the central portion each have a central opening, through both of which means formed on the cover plate extends for engaging the cutting member to secure the hair-pulling member between the cutting member and the cover plate. The outer peripheral portion of the cover plate is axially offset from its inner peripheral portion to provide a flange limiting the movement of each hair-pulling element. The axial offset is so positioned with respect to the inner ends of the connecting arms as to prevent accumulation of hair particles between such inner ends and the cutting member.

1 Claim, 10 Drawing Figures

SHAVING APPARATUS

This invention relates to a shaving apparatus having a shear plate provided with hair entry apertures and a cutting unit which is rotatable relative to the shear plate, which cutting unit comprises a cutting member which is substantially constituted by a central body which is provided with cutters and which cutting member is equipped with hair pulling elements which are respectively arranged in front of the cutters and are movable relative thereto and which are each provided with a connecting arm which at one end is secured to the central body of the cutting member.

Such a shaving apparatus is for example known from U.S. Pat. No. 3,962,784, which describes a cutting member having lead cutters whose connecting arms are secured to the cutting member by glueing or spot-welding. A problem which may occur in use is that hair cuttings become trapped between the connecting arms and the central body, so that the cutting unit may become seriously obstructed.

It is the object of the present invention to eliminate this drawback and this leads to a construction which is characterized in that said one end of each connecting arm is situated between the central body of the cutting member and a cover plate which is secured to the central body.

A special embodiment is characterized in that the cover plate is provided with means for securing it to the central body.

Another special embodiment, however, is characterized in that the hair-pulling elements and the cover plate are secured to the central body by means of a separate coupling member.

A preferred embodiment is characterized in that the cover plate is provided with a flange which has been pressed out of the plane of the cover plate and which constitutes a stop for the connecting arms.

A further special embodiment is characterized in that the cover plate is provided with wall portions which partly extend alongside the connecting arms.

Still another special embodiment is characterized in that the cover plate is manufactured from an elastomeric material.

The invention is also embodied in a cutting unit as used in any of the embodiments of a shaving apparatus defined above.

The invention will now be described in connection with the accompanying drawings, in which.

Figure 6:
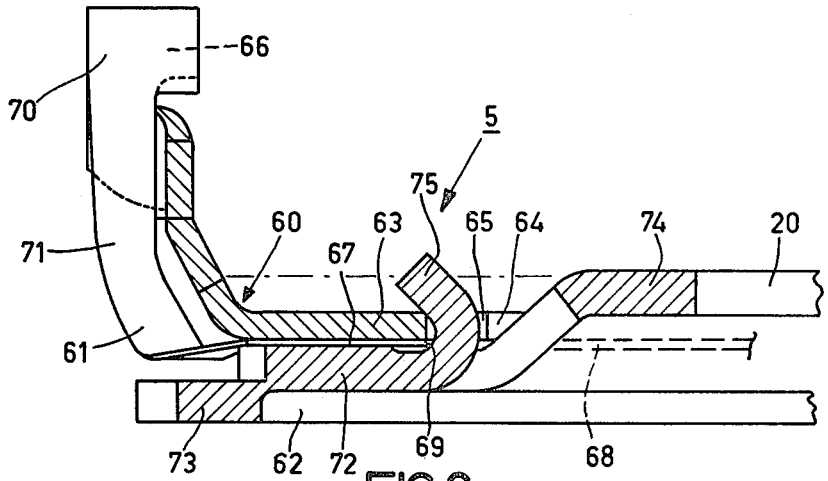

FIG. 6 also shows a partial axial cross-section on a further enlarged scale of still another embodiment of the cutting unit.

Figure 7:
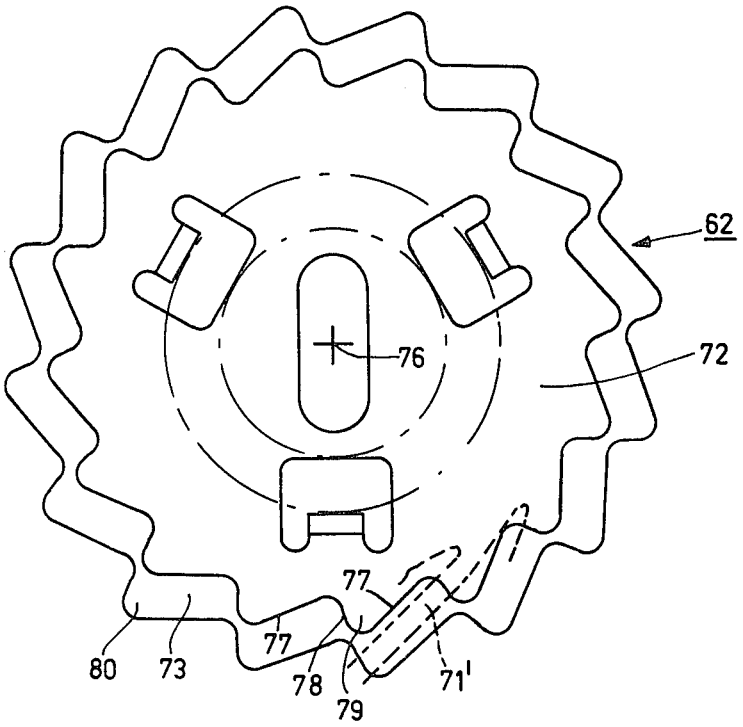

FIG. 7 shows an elevation on a reduced scale of the cover plate of the cutting unit of FIG. 6.

Figure 8:
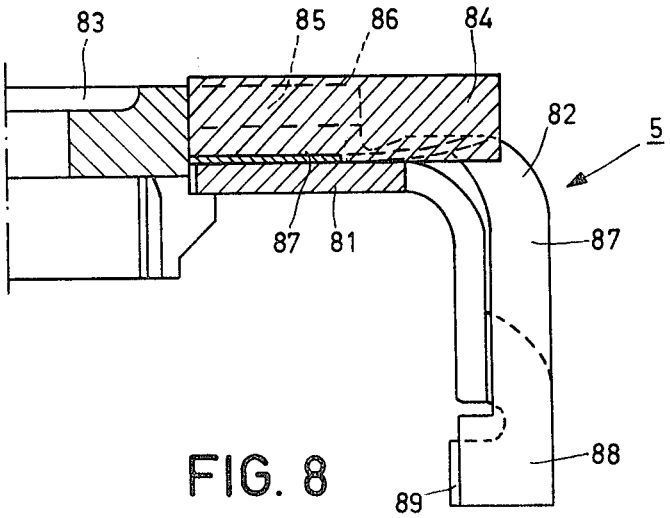

FIG. 8 is a partial axial cross-section on an enlarged scale of a special embodiment of a cutting unit.

Figure 9:
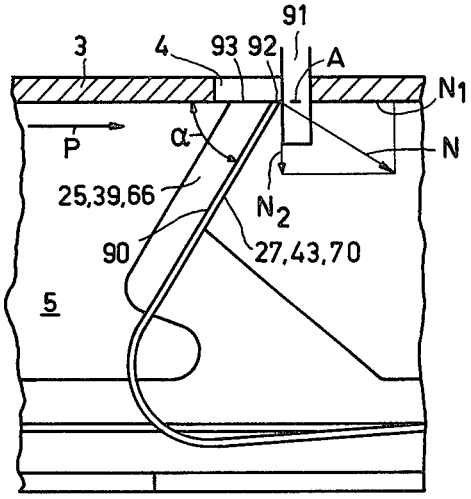
Figure 10:
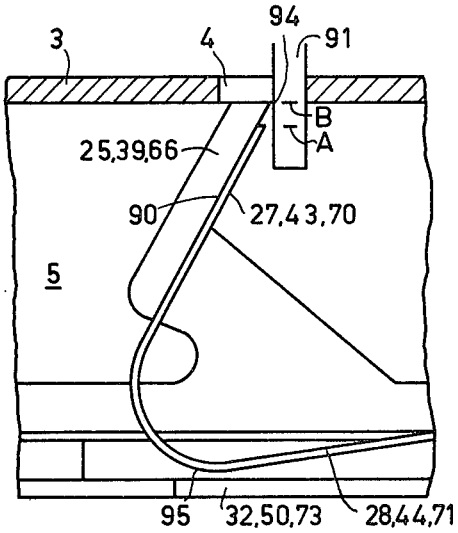

FIGS. 9 and 10 illustrate the operation of a lead cutter.

Figure 1:
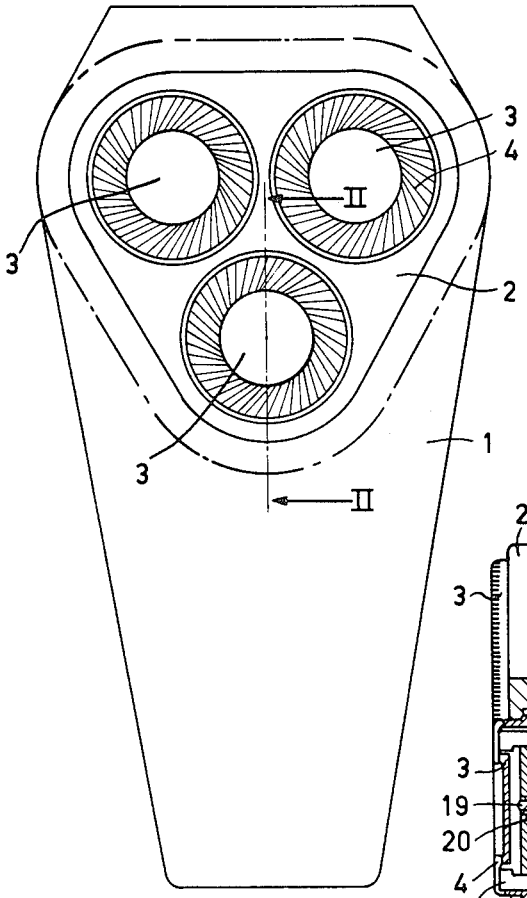
FIG. 1 is an elevation of a shaving apparatus having three shear plates.
Figure 2:
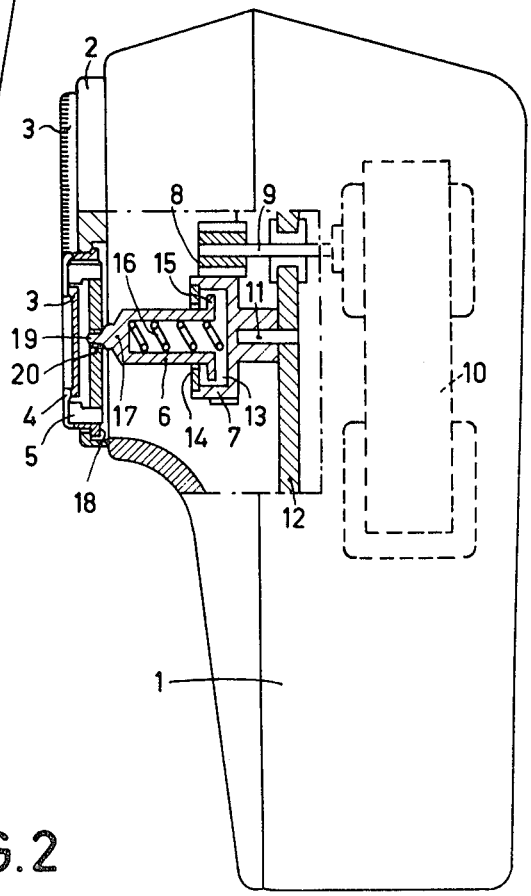
FIG. 2 shows the shaving apparatus of FIG. 1 in a side view and partly in a cross-sectional view taken on the line II—II in FIG. 1.

The shaving apparatus of FIGS. 1 and 2 comprises a housing 1, of which a part takes the form of a shear plate holder 2 for three shear plates 3. The shear plates 3 are formed with hair entry apertures 4.

Figure 3:
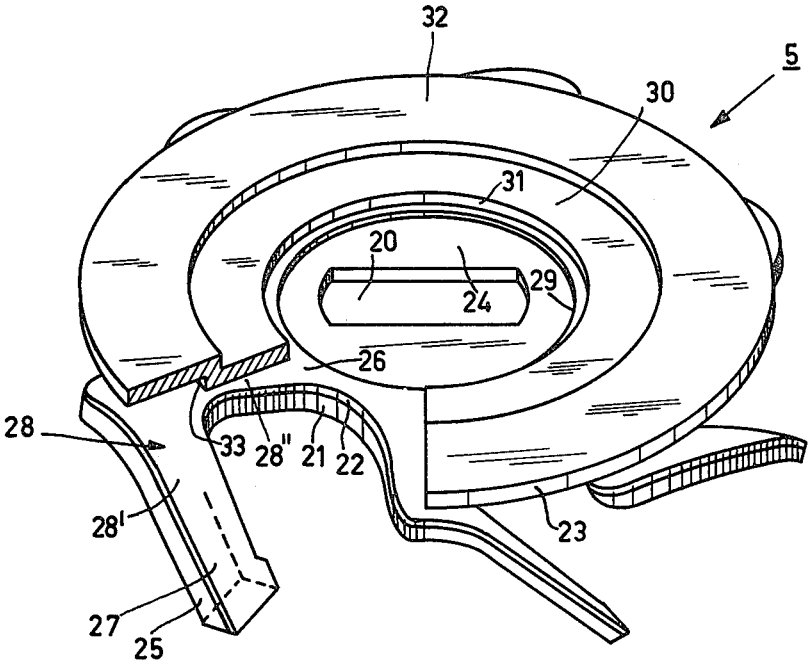
FIG. 3 shows a perspective view on an enlarged scale of a cutting unit with a partly cut-away cover plate.

As shown in the partial cross-section of FIG. 2, a cutting unit 5 is located on the inner side of a shear plate 3, which unit for the sake of clarity is only shown schematically, but which is shown in detail and on an enlarged scale in FIG. 3.

The cutting unit 5 is coupled to the electric motor 10 by means of the hollow spindle 6 (FIG. 2), the gear wheels 7 and 8, and the spindle 9, so that the cutting unit is rotatable relative to the associated shear plate 3. The gear wheel 7 is rotatably journalled on a pin 11, which is mounted in a mounting plate 12. The gear wheel 7 is formed with a recess 13, which is covered by a cover plate 14. In this recess the flange 15 on the end of the hollow spindle 6 is situated. By giving the flange 15 a non-circular, for example square, shape and by shaping the recess 13 accordingly, a coupling is obtained for transmitting the rotary movement from the gear wheel 7 to the spindle 6. The spring 16, which for its greater part is situated in the hollow spindle 6 and which is compressed between the hollow spindle 6 and the gear wheel 7, exerts a force on the spindle 6 in the direction of the cutting unit 5. As the conical portion 17 of the spindle 6 bears against the cutting unit 5 this force is exerted on the cutting unit and via the cutting unit on the shear plate 3, so that flange 18 on the shear plate is urged against the shear plate holder 2. As a result of external forces, as may for example occur during use of the shaving apparatus, the shear plate 3 together with the cutting unit 5 and the spindle 6 can be pressed inwards against the action of the spring 16.

The coupling for transmitting the rotary movement between the spindle 6 and the cutting unit 5 is obtained by providing the spindle 6 with an end portion 19 of substantially rectangular cross-section. This end portion 19 is situated in a correspondingly shaped coupling aperture 20 of the cutting unit 5.

All three cutting units of the apparatus in accordance with FIGS. 1 and 2 are coupled to the motor 10 in the above manner, the three gear wheels 7 being in engagement with a single centrally disposed gear wheel 8 on the motor spindle 9.

The cutting unit (FIG. 3) comprises a cutting member 21, a hair-pulling member 22 and a cover plate 23.

The cutting member 21 is mainly constituted by a central body 24, which at the circumference is provided with cutters 25. The central body 24 is formed with the coupling aperture 20.

The hair-pulling member 22 comprises a central plate-shaped portion 26 to which the hair-pulling elements 27 are connected by means of the connecting arms 28. The central plate-shaped portion 26 has a central opening 29.

The cover plate 23, which is partly cut-away, comprises an annular portion 30 with a central opening 31 and a flange 32 which has been pressed out of the plane of the annular portion.

The cutting member 21, the hair-pulling member 22 and the cover plate 23 are secured to each other in any convenient manner, for example by glueing, spot-welding or screws. The portions 28" of the connecting arms are clamped between the cutting member 21 and the cover plate 23, whilst the portions 28' of the connecting arms together with the hair-pulling elements 27 have some freedom of movement in a direction towards the cover plate 23 owing to the elastic properties of said connecting arms.

The continuous annulus or rim 33 of the annular portion 30 determines the spacing between the portions 28' and 28'' of the connecting arms 28.

The flange 32 functions as a stop which limits the movement of the connecting arms 28'. The function of the hair-pulling elements 27 will be explained hereinafter with reference to FIGS. 9 and 10.

It has been found that the cover plate 23 affords adequate protection against fouling such as trapping of hair cuttings between the connecting arms 28 and the cutting member 21.

The elastic properties of a connecting arm 28 depend, inter alia, on where it is clamped, i.e. on the location of the rim 33. As a result of this the elastic properties of a connecting arm can be simply yet accurately defined within narrow limits by the shape and dimensions of the cover plate 23.

Figure 4:
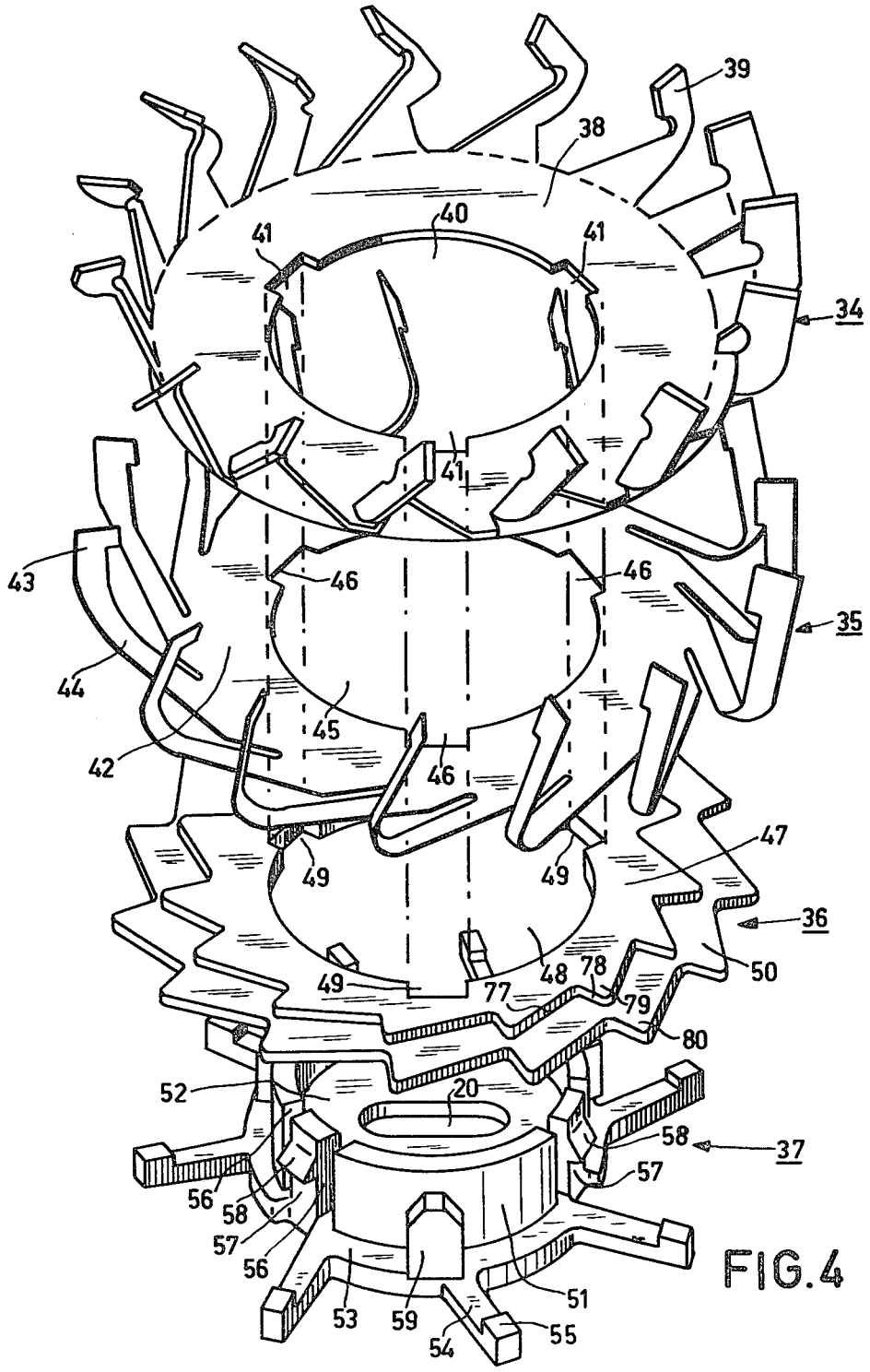
FIG. 4 shows an exploded perspective view of an enlarged scale of another embodiment of a cutting unit.
Figure 5:
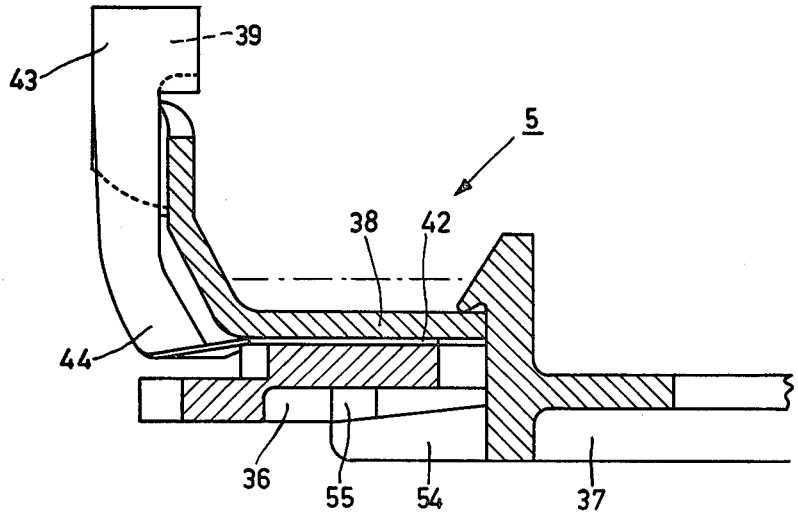
FIG. 5 is a partial axial cross-section on a further enlarged scale of the cutting unit of FIG. 4.

The cutting unit of FIGS. 4 and 5 comprises a cutting member 34, a hair-pulling member 35, a cover plate 36 and a coupling member 37, which parts are shown in exploded perspective view in FIG. 4.

The cutting member 34 is again substantially constituted by a central body 38 which on its circumference is provided with cutters 39. The central body has a central opening 40 and three recesses 41 in its inner periphery.

The hair-pulling member 35 comprises a central plate-shaped portion 42 to which the hair-pulling elements 43 are connected by means of the connecting arms 44. The central plate-shaped portion 42 also has a central opening 45 and three recesses 46 in its inner periphery.

The cover plate 36 comprises an annular portion 47 having a central opening 48 and three recesses 49 in its inner periphery, and a flange 50 which has been pressed out of the plane of the annular portion.

The coupling member 37 comprises a cylindrical portion 51 with a transverse partition 52 and a flange 53. In the transverse partition 52 the coupling aperture 20 is formed for coupling the cutting unit to the hollow spindle 6. The spokes 54 extend from the flange 53 in a substantially radial direction. Said spokes 54 are provided with axially extending projections 55. As a result of the slits 56 in the cylindrical portion 51 the resilient parts 57 of this portion are formed, which parts are provided with hook-shaped projections 58 on their outer sides. On the outside of the cylindrical portion 51 three axially extending ribs 59 are disposed.

The cutting member 34, the hair-pulling member 35 and the cover plate 36 can be simply assembled to form a cutting unit 5 with the aid of the coupling member 37. For this purpose the cutting member, the hair-pulling member and the cover plate are stacked in the sequence shown in FIG. 4, the central openings 40, 45 and 48 and the recesses 41, 46 and 49 coinciding. The cylindrical portion 51 of the coupling member 37 is passed through the central openings, the resilient parts 57 deflecting in an inward radial direction. The ribs 59 then engage with the recesses 41, 46, and 49, so that the parts 34, 35, 36 and 37 cannot be rotated relative to each other. The hook-shaped projections 58 snap behind the central body 38, thus securing the parts 34, 35, 36 and 37 to each other. The snap connections provided by the hook-shaped projections 58 on the resilient parts 57 also enable the cutting unit 5 to be dismantled in a simple manner.

In the assembled condition of the cutting unit 5 (FIG. 5) the hair-pulling elements 43 are positioned against the cutters 39. The central plate-shaped portion 42 and the ends of the connecting arms 44 of the hair-pulling elements 43 which adjoin said portion 42 are situated between the cover plate 36 and the central body 38 of the cutting member 34. The coupling member 37 is dimensioned so that in the assembled condition of the cutting unit 5 the spokes 54 are slightly elastically deflected, as a result of which the cover plate 36 is clamped between the projections 55 and the central body 38. As a result of the elastic properties of that part of each connecting arm 44 which is not clamped in position, each hair-pulling element 43 is again movable relative to the associated cutter 39. The coupling member and the cover plate may be manufactured from a metal or a plastic.

The cover plate 36 satisfactorily shields the connecting arms 44, so that the risk of hair cuttings or other contaminants being trapped between the connecting arms and the cutting member 34 is substantially eliminated.

The significance of the special shape of the cover plate 36 will be explained in connection with FIGS. 6 and 7.

The axial cross-section of FIG. 6 shows a cutting unit 5 which comprises only a cutting member 60, a hair-pulling member 61 and a cover plate 62. As in the previous embodiments the cutting member 60 comprises a central body 63 with a central opening 64 and three recesses 65, and cutters 66, and the hair-pulling member 61 comprises a central plate-shaped portion 67 with a central opening 68 and three recesses 69, hair-pulling elements 70 and connecting arms 71.

The cover plate 62 comprises an inner annular portion 72 and an axially offset outer flange 73 which has been pressed out of the plane of the annular portion 72. A central portion 74 of the cover plate 62, which portion has also been pressed out of the plane of the annular portion 72, is formed with the coupling aperture 20. The cover plate 62 is provided with three bent-over lugs 75, which engage in the recesses 65 and 69 and which clamp the hair-pulling member 61 and the cutting member 60 in position. In this way the cover plate 62 also serves for centring and fixing the parts of the cutting unit.

It is alternatively possible to provide the cover plate with separate centring projections for centring the cutting member, the hair-pulling member and the cover plate relative to each other.

The portions 71' of the connecting arms 71, of which a single arm is represented by broken lines in FIG. 7, and which extend substantially parallel to the plane of the central body 63 of the cutting member 60 are directed tangentially relative to an imaginary circle concentric with the centre of rotation 76 of the cutting unit 5. The annular portion 72 is provided with peripheral wall portions 77 which extend substantially transversely of the plane of the central body 63 and are also directed tangentially of an imaginary circle concentric with the centre of rotation 76 of the cutting unit 5 and which extend alongside the portions 71' of the connecting arms on the inner side. It has been found that these wall portions 77 provide very effective protection against hair cuttings or other contaminants being trapped between the portions 71' and the central body 63.

The peripheral wall portions 78 of the annular portion 72, which portions adjoin the wall portions 77 and which also extend substantially transversely of the plane of the central body, are directed transversely of the longitudinal direction of the portions 71' of the connecting arms and determine the beginning of the clamping of the portions 71' between the cover plate 62 and the cutting member 60. The wall portions 77 and 78 bound teeth-like protrusions 79 on the annular portion 72 which give the circumference of the annular portion 72 a serrated shape.

The circumference of the flange 73 is similarly shaped with protrusions 80 which are situated above the unclamped parts of the portions 71' of the connecting arms. The protrusions 80 again constitute a stop, as will be explained with reference to FIGS. 9 and 10.

The cutting unit 5 as shown in FIG. 8 also comprises a cutting member 81, a hair-pulling member 82 and a coupling member 83 in accordance with the embodiment of FIGS. 4 and 5. However, in this case the cover plate is constituted by a ring 84 of an elastomeric material, such as natural rubber or a synthetic material. The elastomeric material is applied, for example, in the liquid state, after the parts 81, 82 and 83 have been assembled. The spokes 85 and the axially extending projections 86 thereon are then embedded in the ring. The projections 86 bear directly on the connecting arms 87. The material of the ring 84 is sufficiently elastic to provide the freedom of movement of the connecting arms 87 and thus of the hair-pulling elements 88 relative to the cutters 89, which is necessary for the correct operation of the hair-pulling elements.

The cover plate may also take the form of a separate ring which is clamped between the spokes 85 and the hair-pulling member 82, whilst it is alternatively possible to employ a cover plate of an elastomeric material which is secured to both the cutting member and the hair-pulling member, for example by an adhesive, so that the coupling member may be dispensed with.

In these embodiments the cover plate also affords adequate protection against soiling of the cutting unit.

FIGS. 9 and 10 schematically show a side view of a part of a cutting unit 5 and a part of a shear plate 3 and serve to illustrate the operation of the lead cutters.

As is shown in FIGS. 9 and 10 the hair-pulling element (27, 43, 70,) is positioned against the guide wall 90 of the cutter (25, 39, 66), which wall is slightly inclined relative to the shear plate 3. If a hair 91 is caught in a hair entry aperture 4 this hair will soon come into contact with the sharp edge 92 of the hair-pulling element (27, 43, 70,) at the location A as a result of the rotary movement of the cutter (25, 39, 66) and the hair-pulling element (27, 43, 70,). The sharp edge 92 is constructed so that it will slightly penetrate the hair 91, but will not sever the hair. The reaction force which is exerted on the lead cutter by the hair 91 will be directed oppositely to the direction of movement P. This force is counteracted by the component $N_1$ of the normal force N which is exerted on the hair-pulling element by the wall 90 of the cutter (FIG. 9). For the sake of simplicity the small frictional forces between the hair-pulling element and the cutter have been ignored. The component $N_2$ of the normal force N will result in the hair-pulling element sliding along the guide wall 90. The angle $\alpha$ between the guide wall 90 and the wall 93 of the cutter (25, 39, 66) which engages with the shear plate 3 should be smaller than 90°.

As a result of inter alia the natural elasticity of the skin the hair 91 will be moved along by the lead cutter (27, 43, 70) until the cutting edge 94 of the cutter (25, 39, 66) has reached the hair at the location B (FIG. 10). Subsequently, the hair is severed by cooperation of the shear plate 3 and the cutter. In this way a part of the hair 91 is cut off which is longer by an amount equal to the distance between A and B than the part which would be cut off without a hair-pulling element thus yielding a better shaving result.

As is apparent from FIG. 10, point 95 of the connecting arm (28, 44, 71) has not yet reached the flange (32, 50, 73) in this position of the hair-pulling element (27, 43, 70,). However, as a result of inertial forces the hair pulling element may move further in the direction away from the shear plate 3, in which case the flange, and in the embodiments of FIGS. 4 to 7 in particular the protrusions 80, function as a stop which limits the movement of the connecting arm and thus of the hair-pulling element.

In general the use of hair-pulling elements will impose limits on the speed of rotation of the cutting unit. As the amount of kinetic energy of the cutting unit is an important factor in cutting hairs, the action of the apparatus may therefore be improved in some cases by increasing the mass of a cutting unit. For this increase of the mass the cover plate may be used to advantage.

The cover plate moreover provides a satisfactory protection for the comparatively vulnerable hair-pulling member when the cutting unit is taken out of the shaving apparatus and is held in the hand and brushed clean.

Thus, especially the cover plate 62 of the embodiment of FIG. 6 combines many functions, namely: protection against soiling and damaging, fixation of the connecting arms, stop, additional mass, centring and fixation of the parts of the cutting unit and journalling on and coupling to the drive spindle.

What is claimed is:

1. A shaving apparatus having a circular shear plate provided with hair-entrance apertures and a cutting unit associated with and rotatable relative to the shear plate; said cutting unit comprising a cutting member having a circular central body provided with a central opening, a hair-pulling member having a circular central portion provided with a central opening, cutters extending from the circumference of said central body toward the shear plate, hair-pulling elements respectively associated with and movable relative to the cutters, each hair-pulling element, with reference to the direction of rotation of the cutting unit, being positioned in front of its associated cutter, respective connecting arms extending from the hair-pulling elements to the central portion of the hair-pulling member, an annular cover plate positioned over the inner ends of said connecting arms and engaging said central portion, and means formed on said cover plate for extending through the central openings and engaging the cutting member to secure the hair-pulling member between said cutting member and the cover plate, the outer peripheral portion of the cover plate being axially offset from its inner peripheral portion to provide a flange constituting a stop limiting the movement of each hair-pulling element, said outer peripheral portion and said inner peripheral portion of the cover plate being connected by a continuous annulus, the radial dimensions of the two peripheral portions being such that the annulus is positioned with respect to the inner ends of the connecting arms to prevent accumulation of hair clippings and other particles between said inner ends of the connecting arms and the cutting member.

* * * * *